US007351148B1

(12) United States Patent
Rothschild et al.

(10) Patent No.: US 7,351,148 B1
(45) Date of Patent: Apr. 1, 2008

(54) ELECTRONIC SEQUENCE MATCHING GAME AND METHOD OF GAME PLAY USING SAME

(75) Inventors: Omri Rothschild, Tel Aviv-Jaffa (IL); Roni Raviv, Nes-Ziona (IL); Darrell M. Merino, East Longmeadow, MA (US)

(73) Assignees: Hasbro, Inc., Pawtucket, RI (US); R.R Design and Development Ltd., Tel Aviv-Yafo (IL)

( * ) Notice: Subject to any disclaimer, the term of this patent is extended or adjusted under 35 U.S.C. 154(b) by 617 days.

(21) Appl. No.: 10/941,590

(22) Filed: Sep. 15, 2004

(51) Int. Cl.
*A63F 13/00* (2006.01)

(52) U.S. Cl. ..... 463/30; 463/36; 463/37; 463/46; 463/23; 463/1; 463/9; 463/35

(58) Field of Classification Search ..... 463/1, 463/2, 30–33, 35, 36–38, 46, 47; 273/153 R, 273/429, 460
See application file for complete search history.

(56) References Cited

U.S. PATENT DOCUMENTS 4,207,087 A * 6/1980 Morrison et al. ..... 463/9
4,226,163 A * 10/1980 Welcomer ..... 84/422.4
4,240,638 A 12/1980 Morrison et al. ..... 273/237
4,285,517 A * 8/1981 Morrison ..... 463/9
4,320,901 A * 3/1982 Morrison et al. ..... 273/237
4,359,220 A * 11/1982 Morrison et al. ..... 463/9
4,363,482 A 12/1982 Goldfarb ..... 463/9
4,572,513 A 2/1986 Evans ..... 273/242
4,575,087 A * 3/1986 Sinclair ..... 273/153 R
4,722,035 A * 1/1988 Rapisarda ..... 362/109
4,753,146 A * 6/1988 Seiler ..... 84/730
4,770,416 A 9/1988 Shimizu et al. ..... 273/1 GC (Continued)

OTHER PUBLICATIONS

"Air Snares~ electronic Drum game," eBay® Item No. 3144223049, Sep. 2, 2003, downloaded at http://cgi.ebay.com/ws/eBayISAPI.d11?ViewItem&item=3144223049&category=38287, 2 pages.

(Continued)

*Primary Examiner*—John M. Hotaling, II
*Assistant Examiner*—Steven J. Hylinski
(74) *Attorney, Agent, or Firm*—Marshall, Gerstein & Borun LLP

(57) ABSTRACT

The present invention is directed to an apparatus and a method of game play for an electronic sequence matching game the may include a pair of elongated stick member that may be operatively coupled together by an electrical cord so the game play for the electronic matching game may be coordinated between the elongated stick members. During the electronic sequence matching game, the elongated stick members may illuminate different colored lights and generate corresponding sounds in particular sequences, and a player must manipulate the sticks to repeat the sequences generated by the elongated stick members. Depending on the mode of game play, the elongated stick members may repeat the sequence with an additional light being added to the sequence each time the player successfully matches the sequence, or the elongated stick members may generate a new sequence that may be longer or played faster than the previous sequence each time the player successfully matches a sequence. In a further mode, the player may be able to manipulate the elongated stick members in any desired sequence, with the player's manipulation of the elongated stick members causing the stick members to respond with lights and sounds of the music chosen by the player.

38 Claims, 10 Drawing Sheets

U.S. PATENT DOCUMENTS

| | | | | |
|---|---|---|---|---|
| 4,809,979 | A * | 3/1989 | Skowronski et al. | 463/9 |
| 4,957,291 | A | 9/1990 | Miffitt et al. | 273/153 R |
| 4,969,647 | A | 11/1990 | Mical et al. | 273/85 G |
| 5,009,419 | A | 4/1991 | Streeter | 273/454 |
| 5,011,156 | A | 4/1991 | LaChance, Jr. et al. | 273/237 |
| D320,624 | S | 10/1991 | Taylor | D21/13 |
| 5,120,065 | A | 6/1992 | Driscoll et al. | 273/237 |
| 5,192,823 | A * | 3/1993 | Suzuki et al. | 84/600 |
| 5,277,429 | A | 1/1994 | Smith, III | 273/237 |
| 5,280,743 | A * | 1/1994 | Abel et al. | 84/422.4 |
| 5,286,037 | A * | 2/1994 | Ghaly | 463/9 |
| 5,286,909 | A * | 2/1994 | Shibukawa | 84/609 |
| 5,290,964 | A * | 3/1994 | Hiyoshi et al. | 84/600 |
| 5,411,271 | A | 5/1995 | Mirando | 273/434 |
| D363,320 | S | 10/1995 | Barthelemy et al. | D21/48 |
| 5,465,982 | A | 11/1995 | Rebane | 273/433 |
| 5,478,240 | A | 12/1995 | Cogliano | 434/327 |
| 5,630,754 | A | 5/1997 | Rebane | 463/9 |
| 5,685,776 | A * | 11/1997 | Stambolic et al. | 463/46 |
| 5,739,457 | A * | 4/1998 | Devecka | 84/743 |
| 5,816,580 | A | 10/1998 | Osborne et al. | 273/454 |
| 5,839,976 | A | 11/1998 | Darr | 473/414 |
| 5,844,377 | A | 12/1998 | Anderson et al. | 315/251 |
| 5,855,513 | A | 1/1999 | Lam | 463/9 |
| 5,893,798 | A | 4/1999 | Stambolic et al. | 463/46 |
| 5,906,369 | A | 5/1999 | Brennan et al. | 273/238 |
| 6,018,121 | A * | 1/2000 | Devecka | 84/743 |
| 6,075,197 | A * | 6/2000 | Chan | 84/730 |
| 6,086,478 | A * | 7/2000 | Klitsner et al. | 463/35 |
| 6,150,774 | A | 11/2000 | Mueller et al. | 315/291 |
| 6,210,278 | B1 * | 4/2001 | Klitsner | 463/35 |
| 6,215,978 | B1 * | 4/2001 | Ruzic et al. | 434/311 |
| 6,379,244 | B1 * | 4/2002 | Sagawa et al. | 463/7 |
| 6,390,923 | B1 * | 5/2002 | Yoshitomi et al. | 463/43 |
| 6,423,891 | B1 * | 7/2002 | Zengerle | 84/422.4 |
| 6,461,239 | B1 * | 10/2002 | Sagawa et al. | 463/7 |
| 6,479,737 | B1 * | 11/2002 | Lebeda | 84/422.4 |
| 6,540,615 | B2 | 4/2003 | Tanaka et al. | 463/44 |
| 6,586,666 | B2 * | 7/2003 | Abe | 84/477 R |
| 6,626,728 | B2 * | 9/2003 | Holt | 446/219 |
| 6,638,168 | B1 * | 10/2003 | Rehkemper | 463/35 |
| 6,645,067 | B1 * | 11/2003 | Okita et al. | 463/7 |
| 6,786,821 | B2 * | 9/2004 | Nobe et al. | 463/31 |
| 6,835,887 | B2 * | 12/2004 | Devecka | 84/743 |
| 6,848,992 | B2 | 2/2005 | Adams | 463/9 |
| 7,060,000 | B2 * | 6/2006 | Carlson | 482/1 |
| 7,128,649 | B2 * | 10/2006 | Nobe et al. | 463/23 |
| 7,147,556 | B1 * | 12/2006 | Harpaz | 463/9 |
| 2001/0009866 | A1 | 7/2001 | Klitsner et al. | 463/35 |
| 2002/0111202 | A1 | 8/2002 | Annis et al. | 463/7 |
| 2003/0032468 | A1 | 2/2003 | Adams, Jr. | 463/9 |
| 2004/0204240 | A1 * | 10/2004 | Barney | 463/36 |
| 2005/0101364 | A1 * | 5/2005 | Onoda et al. | 463/7 |

OTHER PUBLICATIONS

"Electronic Air Snares game drum sticks NEW," eBay® Item No. 3143836654, Sep. 2, 2003, downloaded at http://cgi.ebay.com/ws/eBayISAPI.d11?ViewItem&item=3143836654& category=232, 2 pages.

"Air Snares Drum Game by Mattel," amazon.com, Sep. 2, 2003, downloaded at http://www.amazon.com/exec/obidos/tg/detail/-/B00005LO9D/102-6848557-8380121?v=glance&s=toys&v . . . , 1 page.

"Air Snares Drum Game by Mattel," amazon.com, Sep. 2, 2003, downloaded at http://www.amazon.com/exec/obidos/tg/stores/detail/-/toys/B00005LO9D/reviews/102-2501523-9173739/1 . . . , 1 page.

"Air Snares Drumming Game," Web News and Product Reviews, Sep. 2, 2003, downloaded at http://www.webdesk.com/air-snares/, 2 pages.

Groove It™ Product Operating Instructions bearing a 2003 copyright registration indication (6 pages).

Nu Jam Guitar™ Product Operating Instructions bearing a 2002 copyright registration indication (6 pages).

U.S. Appl. No. 10/947,736, entitled "Game Having an Electronic Instruction Unit," filed Sep. 23, 2004 (42 pages).

U.S. Appl. No. 11/181,092, entitled "Hand-Held Electronic Game Device," filed Jul. 13, 2005 (29 pages).

U.S. Appl. No. 11/194,508, entitled "Electronic Tag Game and Instruction Unit," filed Aug. 1, 2005 (35 pages).

U.S. Appl. No. 11/421,647, entitled "Game Having an Electronic Instruction Unit with a Mechanical Die Agitator" filed Jun. 1, 2006 (37 pages).

U.S. Appl. No. 11/426,420, entitled "Game Having an Electronic Instruction Unit," filed Jun. 26, 2006 (39 pages).

U.S. Appl. No. 29/213,305 filed Sep. 15, 2004, and listing Darrell Merino and Peter M. Kullgren as inventors (27087/40092) (12 pages).

* cited by examiner

ELECTRONIC SEQUENCE MATCHING GAME AND METHOD OF GAME PLAY USING SAME

BACKGROUND

The present disclosure relates to a matching game, and more particularly to an electronic sequence matching game wherein a pair of elongated stick elements having multi-color LEDs and speakers illuminate colors, and generate sounds corresponding to the illuminated colors, in predetermined sequences, and players manipulate the elongated stick elements with movements corresponding to the illuminated colors to match the sequences of illuminated colors.

Various electronic matching and sound reproduction games have been previously described. For example, U.S. Pat. No. 5,855,513 to Lam discloses a game having a housing with a plurality of spaces defined on the exterior of the housing. Each of the spaces has a space input device and space indicator associated with the space, and each space indicator has an off-state and an on-state. Inside the housing is a controller which communicates with each of the space input devices and space indicators and also with a select input device. The controller is responsive to activation of the select input device followed by activation of a predetermined one of the space input devices for causing the space indicator corresponding to the space selected by the activated space input device to go to the on-state.

The Air Snares® electronic game by Mattel includes a pair of electronic drumsticks having built-in speakers and LEDs. The game produces different drum, symbol and special effect sounds, and different melodies, and has three modes of play. In the first, or repeat the beat, mode, the electronic drumsticks play a basic drum riff or beat accompanied by a back beat. When the basic drumbeat stops and LED(s) of the electronic drumsticks light up, the player attempts to repeat the drum rhythm that the electronic drumsticks produced. After the player completes the drum beat sequence, the electronic drumsticks rate the player's performance and generate an audible score simulating crowd noise. In the second, or follow the beat, mode, the electronic drumsticks play a back beat rhythm, and the player must play along with the drum sounds/riff within the same tempo and speed of the melody. The electronic drumsticks automatically select the type of drum being played and change accordingly with the music. After the entire musical tune has been played, the master electronic drumstick scores the players performance depending on how many times the player was on and off rhythm. In the third, or free play, mode, the electronic drumsticks enable the player to play the electronic drumsticks as they would a regular set of drums. The player may select between the different types of drums and special effect sounds.

SUMMARY OF THE INVENTION

In one aspect, the invention is directed to an electronic game for use by at least one player. The electronic game may include a first game element having a first illumination source configured to illuminate a plurality of different colors, and a first manipulation detection mechanism configured to detect the manipulation of the first game element by the player. The electronic game may further include a second game element having a second illumination source configured to illuminate a plurality of different colors, and a second manipulation detection mechanism configured to detect the manipulation of the second game element by the player, and wherein the second game element may be operatively coupled to the first game element. Each of the plurality of colors illuminated by the first and the second illumination sources may correspond to a particular manipulation of at least one of the first and the second game elements by the player, and the first and second manipulation detection mechanisms may be configured to compare the manipulation of the first and second game elements by the player to the particular manipulation corresponding to an illuminated one of the plurality of different colors.

In another aspect, the invention is directed to an electronic game for use by at least one player. The electronic game may include a first elongated game element that may have a first illumination source configured to illuminate a first color, a second color and a third color, a first motion switch, a first magnetic switch, and a first controller operatively coupled to the first illumination source, the first motion switch and the first magnetic switch. The electronic game may further include a second elongated game element that may have a second illumination source configured to illuminate the second color, the third color and a fourth color, a second motion switch, a second magnetic switch, and a second controller operatively coupled to the second illumination source, the second motion switch, the second magnetic switch and the first controller. The first controller being programmed to cause the first illumination source to illuminate the first color in response to detecting motion of the first elongated game element at the first motion switch, and not detecting motion of the second elongated game element at the second motion switch. The first controller may be programmed to cause the first illumination source to illuminate the second color, and the second controller may be programmed to cause the second illumination source to illuminate the second color, in response to detecting motion of the first elongated game element at the first motion switch, and motion of the second elongated game element at the second motion switch. Further, the first controller may be programmed to cause the first illumination source to illuminate the third color, and the second controller may be programmed to cause the second illumination source to illuminate the third color, in response to detecting that the first magnetic switch is disposed proximate the second magnetic switch. Moreover, the second controller may be programmed to cause the second illumination source to illuminate the fourth color in response to detecting motion of the second elongated game element at the second motion switch, and not detecting motion of the first elongated game element at the first motion switch.

In a further aspect, the invention is directed to a method of game play for an electronic game for use by at least one player wherein first and second operatively couple game elements may be provide, wherein the first and second game elements may be responsive to manipulations by the player, and each may be configured to illuminate a plurality of different color lights. The first and second game elements may be configured to illuminate a sequence of the different color lights, and to detect the manipulation of the first and second game elements by the player after the first and second game elements illuminate the sequence of different color lights. Each of the different color lights may have a corresponding manipulation of at least one of the first and second game elements. Further, the first and the second elements may be configured to compare the sequence of the detected manipulations of the first and second game elements to the sequence of different color lights.

In an additional aspect, the invention is directed to a game apparatus having a pair of game elements operatively coupled to each other. Each game element may include a plurality of input devices each requiring manipulation of at least the corresponding game element for actuation, wherein at least two of the input devices require different manipulations for actuation, a visual output device, and a controller operatively coupled to each of the input devices and to the visual output device. The controllers may output a first sequence of first command signals to the visual output devices, and each of the first command signals of the first sequence may correspond to one of the plurality of input devices. The controllers may further output a second sequence of first command signals to the visual output devices when the input devices corresponding to the first command signals are actuated in the first sequence within a predetermined period of time, with each of the first command signals of the second sequence corresponding to one of the plurality of input devices. Moreover, the controllers may further output first error command signals to the visual output devices when the input devices are not actuated in the first sequence or when the input devices are not actuated within the predetermined period of time.

Still further, in one aspect the invention is directed to a method of playing an electronic sequence matching game. The method may include outputting a first sequence of first command signals to visual output devices of a pair of operatively coupled game elements, wherein each of the first command signals of the first sequence may correspond to one of a plurality of input devices of the game elements, wherein the plurality of input devices may each require manipulation of at least the corresponding game element for actuation, and wherein at least two of the input devices may require different manipulations for actuation. The method may also include outputting a second sequence of first command signals to the visual output devices when the input devices corresponding to the first command signals are actuated in the first sequence within a predetermined period of time, with each of the first command signals of the second sequence corresponding to one of the plurality of input devices, and outputting first error command signals to the visual output devices when the input devices are not actuated in the first sequence or when the input devices are not actuated within the predetermined period of time.

Additional aspects of the invention are defined by the claims of this patent.

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined, in this patent using the sentence "As used herein, the term '_____' is hereby defined to mean . . ." or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Figure 1:
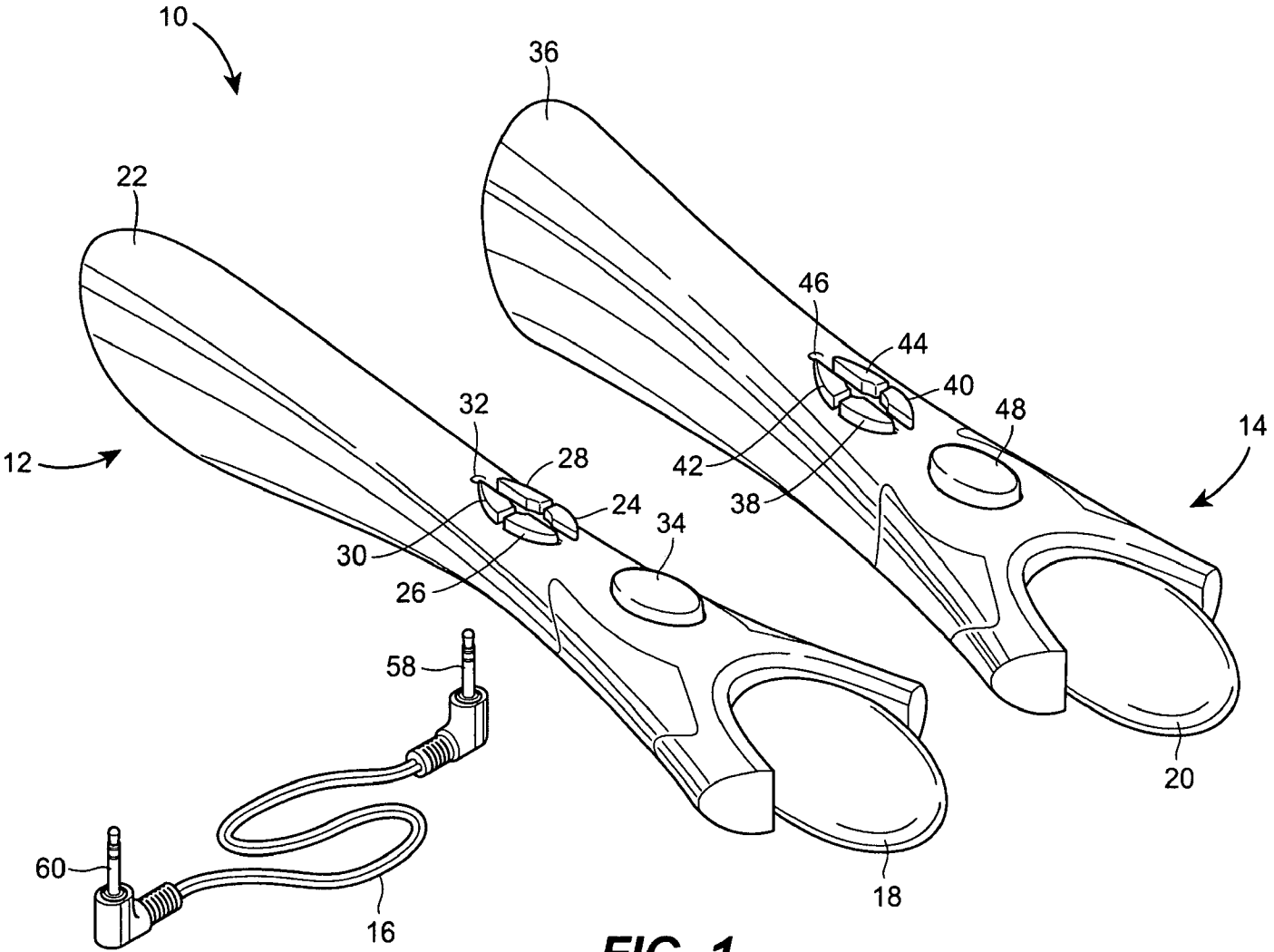
FIG. 1 is a perspective view of an embodiment of an electronic matching game having a pair of elongated stick members in accordance with the invention.

FIG. 1 illustrates one possible embodiment of an electronic sequence matching game 10 in accordance with the invention. In the illustrated embodiment, the electronic sequence matching game 10 may include a first elongated stick member 12 and a second elongated stick member 14 that may be operatively coupled together by an electrical cord 16 so the game play for the electronic matching game may be coordinated between the elongated stick members 12, 14. During the matching game, the elongated stick members 12, 14 may illuminate different colored lights within bulbs 18, 20 and generate corresponding sounds in particular sequences, and a player must manipulate the sticks to repeat the sequences generated by the elongated stick members 12, 14. Depending on the mode of game play, the elongated stick members 12, 14 may repeat the sequence with an additional light being added to the sequence each time the player successfully matches the sequence, or the elongated stick members 12, 14 may generate a new sequence that may be longer or played faster than the previous sequence each time the player successfully matches a sequence. In a further mode, the player may be able to manipulate the elongated stick members 12, 14 in any desired sequence, with the player's manipulation of the elongated stick members 12, 14 causing the stick members 12, 14 to respond with lights and sounds of the music chosen by the player. The game play modes for the electronic sequence matching game 10 will be further illustrated and described with reference to FIGS. 9 and 10.

Returning to FIG. 1, the first elongated stick member 12 may include a first elongated housing 22 enclosing the electronic components of the first elongated stick member 12, and engaging the first bulb 18 to retain the bulb 18 proximate the lights of the first elongated stick member 12 such that the bulb 18 may be illuminated when the lights are illuminated. The housing 22 may be shaped such that a player may grasp the end of the housing 22 distal to the bulb 18 in a manner similar to a drumstick such that the player may shake the elongated stick member 12 in a similar manner to playing a drum. The first elongated stick member 12 may further include a plurality of buttons 24, 26, 28, 30 that may be depressed to actuate switches disposed thereunder to control various aspects of the game play for the electronic sequence matching game 10.

A power button 24 may be pressed to alternately turn on and turn off the electronic sequence matching game 10. Once the power is turned on by depressing the power button 24, a game select button 26 may be depressed by the player to select a desired one of the available games or modes of game play provided by the electronic sequence matching game 10. The first elongated stick member 12 may further include a decrease skill level button 28 and an increase skill level button 30. The buttons 28, 30 may be depressed in order to play the game selected by the game select button 26 at a desired skill level. Increasing the skill level for a game by depressing the increase skill level button 30 may cause the electronic sequence matching game 10 to increase the maximum number of signals in a given sequence during the game play, to increase the speed with which the sequence is played for the player by the electronic sequence matching game 10 or otherwise increase the difficulty for the player to match the sequences. Conversely, depressing the decreased skill level button 28 may reduce the number of signals in the sequence and the speed with which the sequences are played, or otherwise reduce the difficulty of the game. In addition to the readily accessible buttons 24, 26, 28, 30, the first elongated housing 22 may include a reset button access opening 32 in which may be disposed a reset button (not shown) that, when depressed, may cause the electronic sequence matching game 10 to reset to an initial operational state and clear the historical game information stored for the electronic sequence matching game 10, such as the high scores for each game mode, that may be stored therein.

The first elongated hosing 22 may further include a magnetic switch indicator area, such as an oval 34, that may indicate the position at which a magnetic switch within the first elongated stick member 12 is disposed for reference by the player while playing the electronic sequence matching game 10. The magnetic switch in the first elongated stick member 12, and a corresponding magnetic switch in the second elongated stick member 14, may cooperate in a manner discussed more fully below to signal that the first and second elongated stick members 12, 14 are disposed proximate each other by the player during the electronic sequence matching game 10.

Similar to the first elongated stick member 12, the second elongated stick member 14 may include a second elongated housing 36 engaging the second bulb 20, a plurality of control buttons 38, 40, 42, 44, a reset button access opening 46, and a magnetic switch indicator area, such as oval 48. The second elongated housing 36 may be configured similar to the first elongated housing 22 such that the player may grasp the end of the housing 36 distal to the second bulb 20 in a similar manner as a drumstick such that the player may shake the second elongated stick member 14 in a manner simulating the playing of a drum. Forward music mix button 38 and reverse music mix button 40 may allow the player to cycle through and select a desired one of a plurality of available background beats to be played by the elongated stick member 12, 14 during the electronic sequence matching game 10. The forward music mix button 38 may allow the player to cycle through the available beats in one order, while the reverse music mix button 40 may allow the player to cycle through the available beats in the opposite order. The volume buttons 42, 44 increase and decrease, respectively, the volume of the sounds generated by the elongated stick members 12, 14. The reset button access opening 46 and magnetic switch indicator area 48 may be configured to perform similar functions as the corresponding reset button access opening 32 and magnetic switch indicator area 34, respectively, of the first elongated stick member 12.

Figure 2:
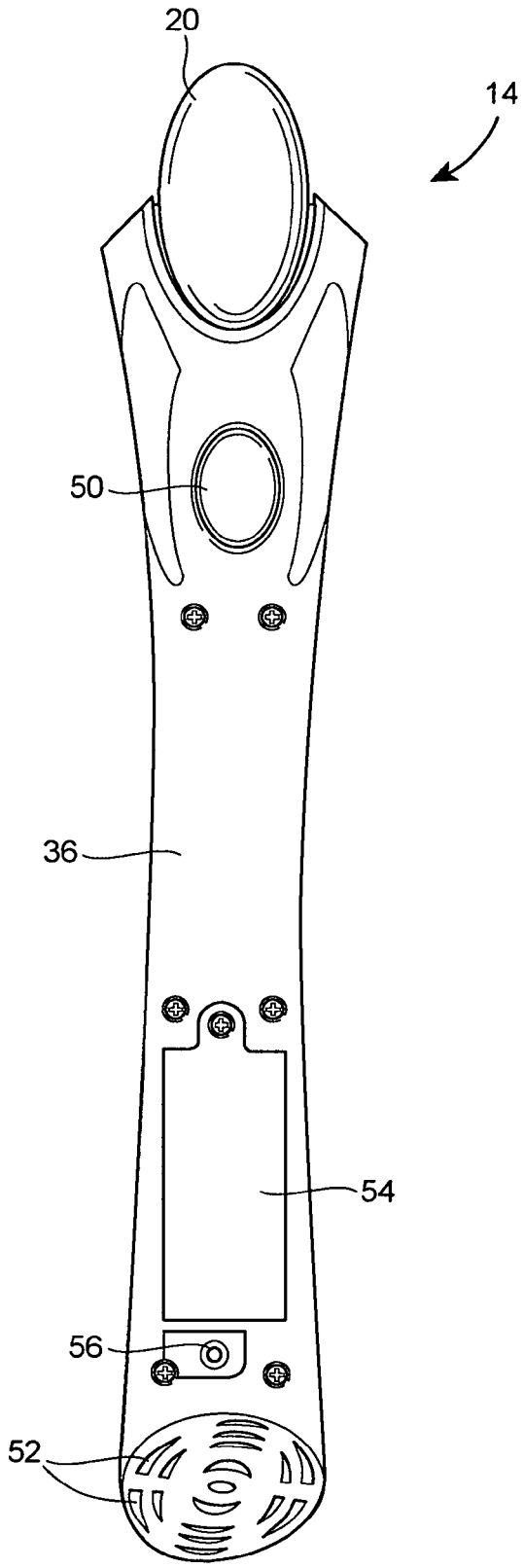
FIG. 2 is a rear view of one of the elongated stick members of the electronic matching game of FIG. 1.

Referring to FIG. 2, which is a bottom view of the second elongated stick member 14, the elongated housing 36 may include a magnetic switch indicator area, such as an oval 50 disposed the opposite the oval 48 on the top of the elongated housing 36 and, consequently, disposed proximate the magnetic switch disposed within the elongated housing 36 to indicate the location of the magnetic switch for the player. The housing 36 may further include a plurality of openings 52 disposed proximate an internal speaker (not shown) such that sounds generated by the speaker may be audible to the player external to the elongated housing 36. The elongated housing 36 may further include a cover 54 providing access to a battery compartment providing a power source for the elongated stick member 14. In order to operatively couple the second elongated stick member 14 to the first elongated stick member 12, the housing 36 may include a plug receptacle 56 that may be configured to receive one of the plugs 58, 60 (FIG. 1) disposed at either end of the cord 16. While not shown, the bottom of the first elongated housing 22 may also include similarly configured magnetic switch area, speaker openings, battery compartment cover, and plug receptacle.

Figure 3:
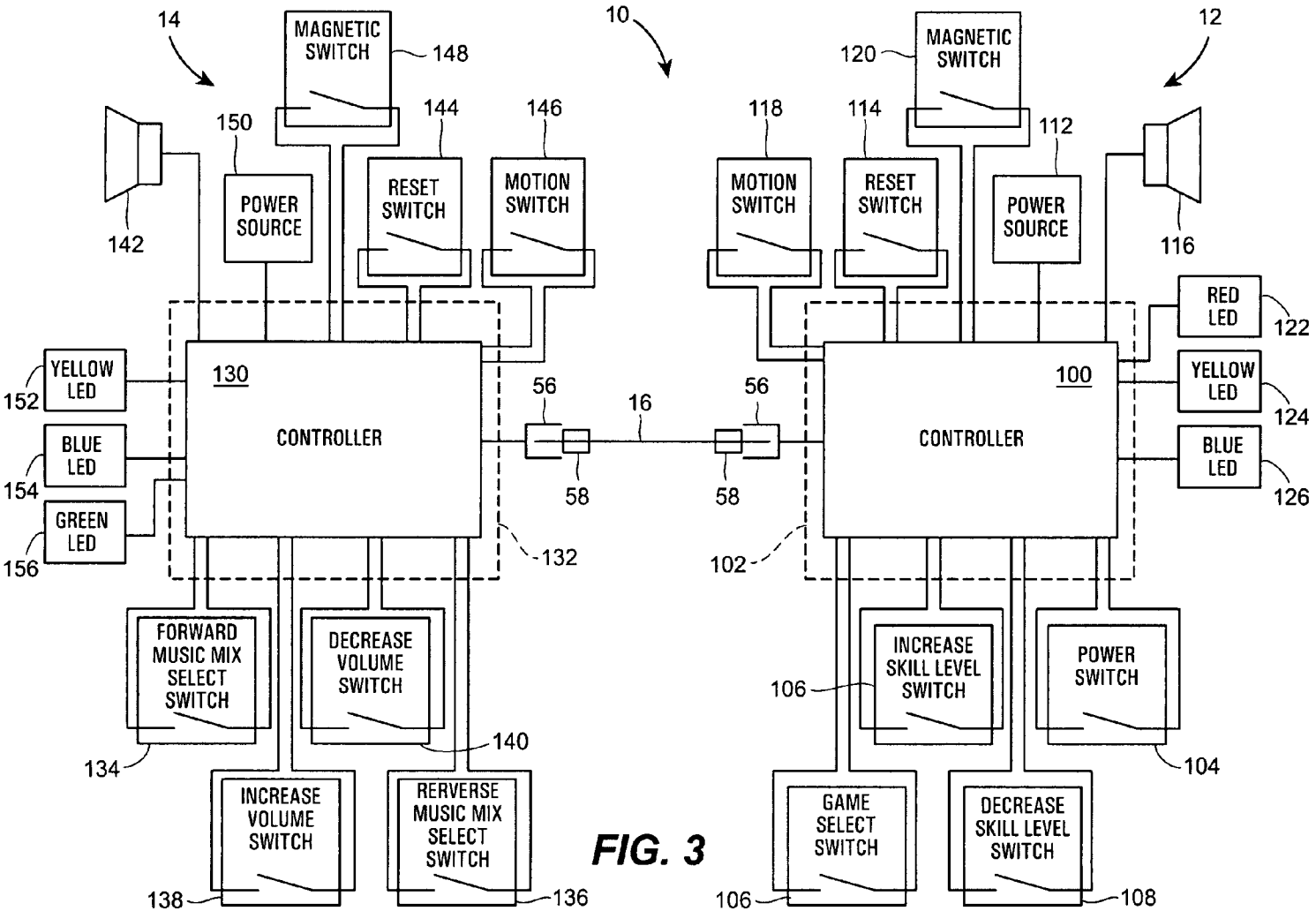
FIG. 3 is a block diagram of the electronic components of the electronic matching game of FIG. 1.

FIG. 3 is a block diagram of a number of components that may be incorporated into the electronic sequence matching game 10. Referring to FIG. 3, the first elongated stick member 12 of the electronic sequence matching game 10 may include a first controller 100 implemented on a printed circuit board 102 and containing the game logic and sound generation data implemented via circuitry contained on the conventional printed circuit board 102, with the game execution logic and sound generation data being stored directly on the printed circuit board 102. It should also be appreciated that although the first controller 100 may be implemented on the printed circuit board 102, more complex implementations of the electronic sequence matching game 10 may be implemented wherein the first controller 100 may comprise, among other components, a program memory, a microcontroller or microprocessor (MP), a random-access memory (RAM), read-only memory (ROM), and an input/output (I/O) circuit, all of which may be interconnected. It should be appreciated that the first controller 100 may include multiple microprocessors. Similarly, the memory of the first controller 100 may include multiple RAMs and multiple program memories, depending on the complexity and requirements of a specific implementation. It should also be appreciated that the I/O circuit may include a number of different types of I/O circuits, such as sound generation circuits, video generation circuit, odor generation circuitry, and the like. The RAM(s), ROM(s) and program memories may be implemented as semi-conductor memories, magnetically readable memories, and/or optically readable memories, for example.

FIG. 3 illustrates that the first controller 100 may be operatively coupled to various electronic components corresponding to the exterior components to the first elongated stick member 12 discussed in relation to FIGS. 1 and 2, with each of those components being so coupled to the first controller 10 via a respective direct line or conductor. Different connection schemes may be used. The switches 104, 106, 108, 110 correspond to the control buttons 24, 26, 28, 30 disposed on the exterior of the first elongated housing 22. Input signals produced by the switches 104, 106, 108, 110 are output to the first controller 100 for processing the game execution logic. A power switch 104 may be closed when the power button 24 is depressed by the player, thereby turning on the electronic sequence matching game 10, with the first controller 100 drawing power from a power source 112, such as batteries stored within the battery compartment beneath the cover 54. Depressing the power button 24 and, consequently, closing the power switch 104 when the matching game 10 is powered on may cause the first controller 100 to power down the electronic sequence matching game 10. A game selection switch 106, which may be actuated by depressing the game selection button 26, may cause the first controller 100 to cycle through a plurality of available game modes offered by the electronic sequence matching game 10. A decreased skill level switch 108 and an increase skill level 110 may be actuated by depressing the decreased skill level button 28 and increased skill level button 30, respectively, to adjust the skill level of the game mode selected using switch 106 to the player's desired level of difficulty. A reset switch 114 may correspond to a reset button disposed within reset button access opening 32, with the actuation of the reset switch 114 by depressing the reset button causing the first controller 100 to reset the electronic sequence matching game 10 to an initial operational state. Depending on the processing performed in response to actuation of the switches connected to the first controller 100, the circuitry of the first controller 100 may generate and output sound generation command signals to an audible output device, such as a speaker 116, wherein the speaker 116 translates the output command signals into sounds which can be heard by the participants of the electronic sequence matching game 10. The general and specific technologies relating to the electronic sound generation circuitry, and the software required to run such devices, are well-known to those skilled in the electronic and software arts, and therefore the specific details of the digital processing and memory portions of such circuitry, and the specific details of any software required for this specific application will not be described further herein.

As previously discussed, the elongated stick members 12, 14 may be manipulated by the players during game play to recreate the sequence of light and sound command signals generated by the electronic sequence matching game 10. The manipulation of the elongated stick members 12, 14 may include moving or shaking the elongated stick members 12, 14 in a particular manner, or bringing the elongated stick members 12, 14 into close proximity. In order to detect these manipulations, the elongated stick member 12 may include a plurality of input devices, such as a motion switch 18 and a magnetic switch 120, operatively coupled to the first controller 100 and configured to be actuated in response to particular manipulations of one or both elongated stick members 12, 14. The motion switch 118 may be any type of switch or device known in the art that may close in response to a particular movement of the elongated stick member 12 such that closing of the motion switch 18 in response to the movement of the elongated stick member 12 may be detected by the first controller 100. For example, the motion switch 18 may be installed and oriented within the first elongated stick member 12 such that the motion switch 118 may close when a player grasps the elongated housing 22 and shakes the elongated stick member 12 in a manner simulating the swinging of a drumstick to play a drum. Those skilled in the art will understand the motion switch 118 may be selected and installed within the elongated housing 22 such that the motion switch 118 may be closed when the elongated stick member 12 is manipulated with a particular desired motion such that the motion of the elongated stick member 12 is detected by the first controller 100.

The magnetic switch 120 may be any type of switch capable of detecting proximity to a corresponding element disposed within the second elongated stick member 14 such that the closure of the magnetic switch 120 may be detected by the first controller 100 to indicate manipulation of the elongated stick members 12, 14 placing the elongated stick members 12, 14 in close proximity. The magnetic switch 120 may be installed within the elongated housing 22 proximate the oval 34 such that the position of the magnetic switch 120 may be identified from the exterior of the elongated housing 22, and the magnetic switch 120 may be positioned to detect the proximity of the corresponding element of the second elongated stick member 14. While the switch 120 is disclosed herein as being a magnetic switch, those skilled in the art will understand that the switch 120 may be any switch or mechanism capable of detecting proximity of the second elongated stick member 14 to the first elongated stick member 12, such as magnetic switch as described herein, optical sensors, contact switches, and the like.

In order to provide a visual indication of the sequences, and the player's manipulation of the elongated stick members 12, 14, the elongated stick member 12 may further include at least one visual output device of illumination source capable of generating a plurality of different colored lights corresponding to the elements of the game sequences and the manipulations of the elongated stick members 12, 14. As one example, the illumination source may be in the form of a tri-colored LED including a red LED 122, a yellow LED 124 and a blue LED 126 operatively coupled to the first controller 100. The LEDs 122, 124, 126 of the tri-colored LED may be disposed within the first bulb 18 of the first elongated stick member 12, with the first bulb 18 being partially or fully translucent such that the colored light may be visible from the exterior of the first bulb 18 when the LEDs 122, 124, 126 are illuminated. While the illumination sources are illustrated herein as light omitting diodes, it will be understood by those skilled in the art that any other visual output device or devices capable of producing the desired colored lights may be implemented for use in the electronic sequence matching game 10. Further, colors other than or in additional to red, green, blue and yellow may be used in the electronic sequence matching game 10 to achieve a desired game play.

FIG. 3 further illustrates the components that may be incorporated in to the second elongated stick member 14 of the electronic sequence matching game 10. The second elongated stick member 14 may include a second controller 130 implemented on a printed circuit board 132 and containing the game logic and sound generation data implemented via circuitry contained on the conventional printed circuit board 132, with the game execution logic and sound generation data being stored directly on the printed circuit board 132. As with the first controller 100 and printed circuit board 102, the second controller 130 and printed circuit board 132 may be configured in any manner, and contain the necessary components, for implementing the electronic sequence matching game 10. The second controller 130 may be operatively connected to a forward music mix select switch 134, a reverse music mix select switch 136, an increase volume switch 138, and a decreased volume switch 140 corresponding to the external control buttons 38, 40, 42, 44, respectively, of the elongated stick member 14 such that depressing the control buttons 38, 40, 42, 44 may closed the corresponding switches 134, 136, 138, 140, respectively, to cause the second controller 130 to select the background music mix and volume for the sound generation command signals generated by the first and second controllers 100, 130 and output to the first speaker 116 and a second audible output device, second speaker 142, respectively. A reset switch 144 may be operatively connected to the second controller 130 and correspond to a second reset switch disposed within the reset button access opening 46 with the actuation of the reset switch 144 causing the first controller 100 and second controller 130 to reset the electronic sequence matching game 10 to an initial operational state.

The second elongated stick member 14 may further include input devices such as a second motion switch 146 and a second magnetic switch 148 operatively coupled to the second controller 130. The second motion switch 146 may be similar to the first motion switch 118, and may be disposed and oriented within the second elongated housing 36 such that the second motion switch 146 closes when the second elongated stick member 14 is manipulated in a particular manner so that the second controller 130 may detect the motion of the second elongated stick member 14. The second magnetic switch 148 may be disposed within the second elongated housing 36 proximate the ovals 48, 50 such that the proximity of the first magnetic switch 120 and the second magnetic switch 148 when the oval 34 is disposed proximate the ovals 48, 50 the magnetic switches 120, 148 cause each other to close, thereby causing the controllers 100, 130 to detect that the elongated stick members 12, 14 have been manipulated to be disposed in close proximity.

The second elongated stick member 14 may further include a separate power source 150 operatively coupled thereto to provide power to the components of the elongated stick member 14 when the power switch 104 is actuated to turn on the electronic sequence matching game 10. The first controller 100 and second controller 130 may be operatively coupled by the cord 16 when the plugs 58, 60 are inserted into the plug receptacles 56 of the elongated stick members 12, 14. When the power switch 104 is actuated to turn on the electronic sequence matching game 10, the first controller 100 may transmit a signal to the second controller 130 via the cord 16 causing the second controller 130 to correspondingly turn on the second elongated stick member 14 under the power provided by the power source 150. While the controllers 100, 130 are illustrated herein as being operatively coupled via the hard wire connection provided by the cord 16, those skilled in the art will understand that the electronic sequence matching game 10 may be implemented with any desired means for communications between the controllers 100, 130 and thereby operatively couple the controllers 100, 130, such as infra-red communications, radio frequency communications, and the like.

As with the first elongated stick member 12, the second elongated stick member 14 may include at least one visual output device or illumination source, such as a tri-colored LED operatively coupled to the second controller 130 to produce a desired plurality of colored lights indicative of the command signals of the sequences and the manipulation of the second elongated stick member 14. The tri-colored LED may include a yellow LED 152, a blue LED 154 and a green LED 156 disposed within the second bulb 20 of the second elongated stick member 14. As with the first bulb 18, the second bulb 20 may be partially or fully translucent such that the colored light from the LEDs 152, 154, 156 may be visible from the exterior of the second bulb 20. As with the LEDs 122, 124, 126, the LEDs 152, 154, 156 may be replaced by any other visual output device capable of producing a plurality of desired colors, including desired colors other than or in addition to yellow, blue and green shown in the illustrated embodiment.

Figure 4:
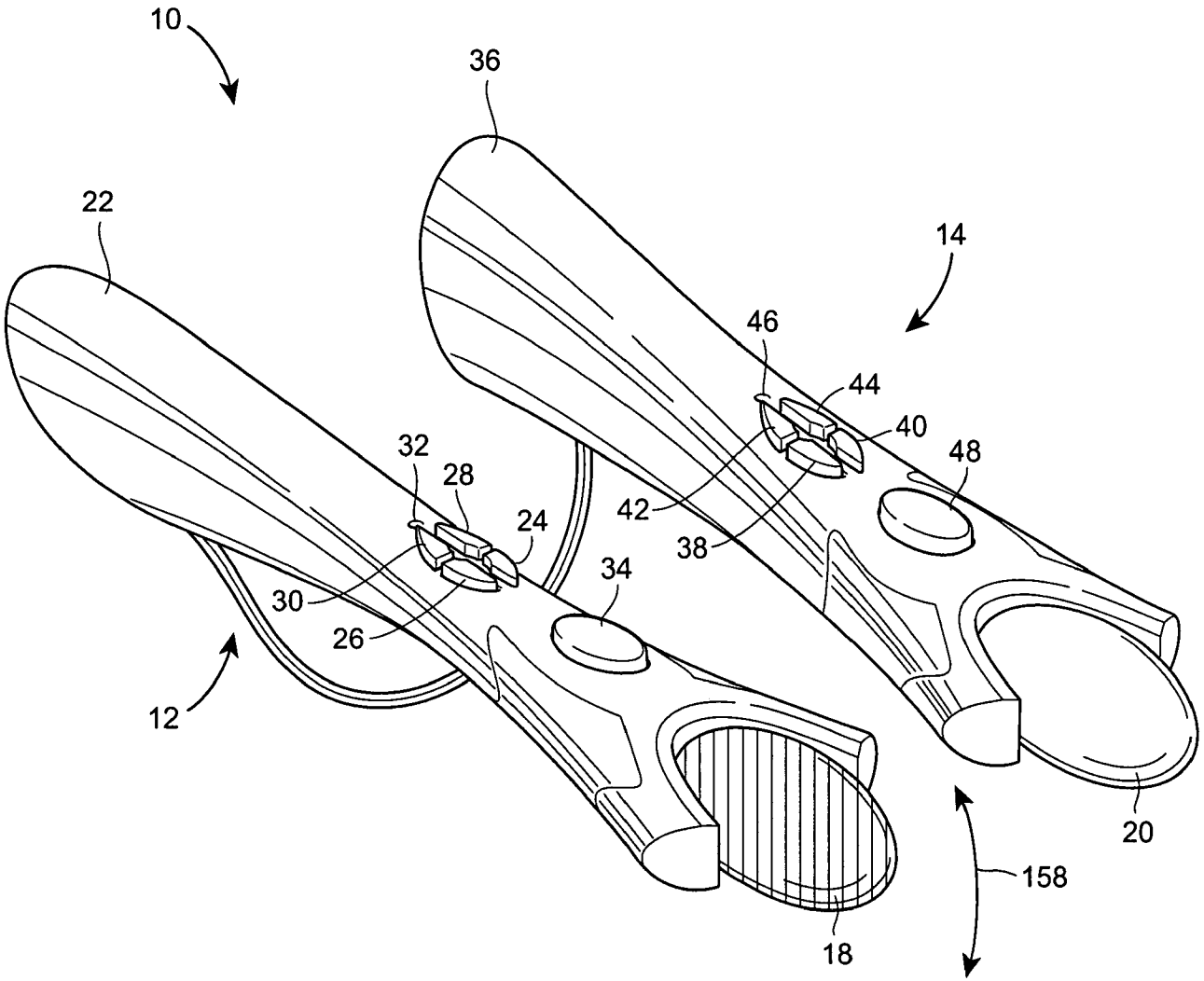
FIG. 4 is a perspective view of the electronic matching game of the FIG. 1 with the bulb of the first elongated stick element illuminated with the color red.
Figure 5:
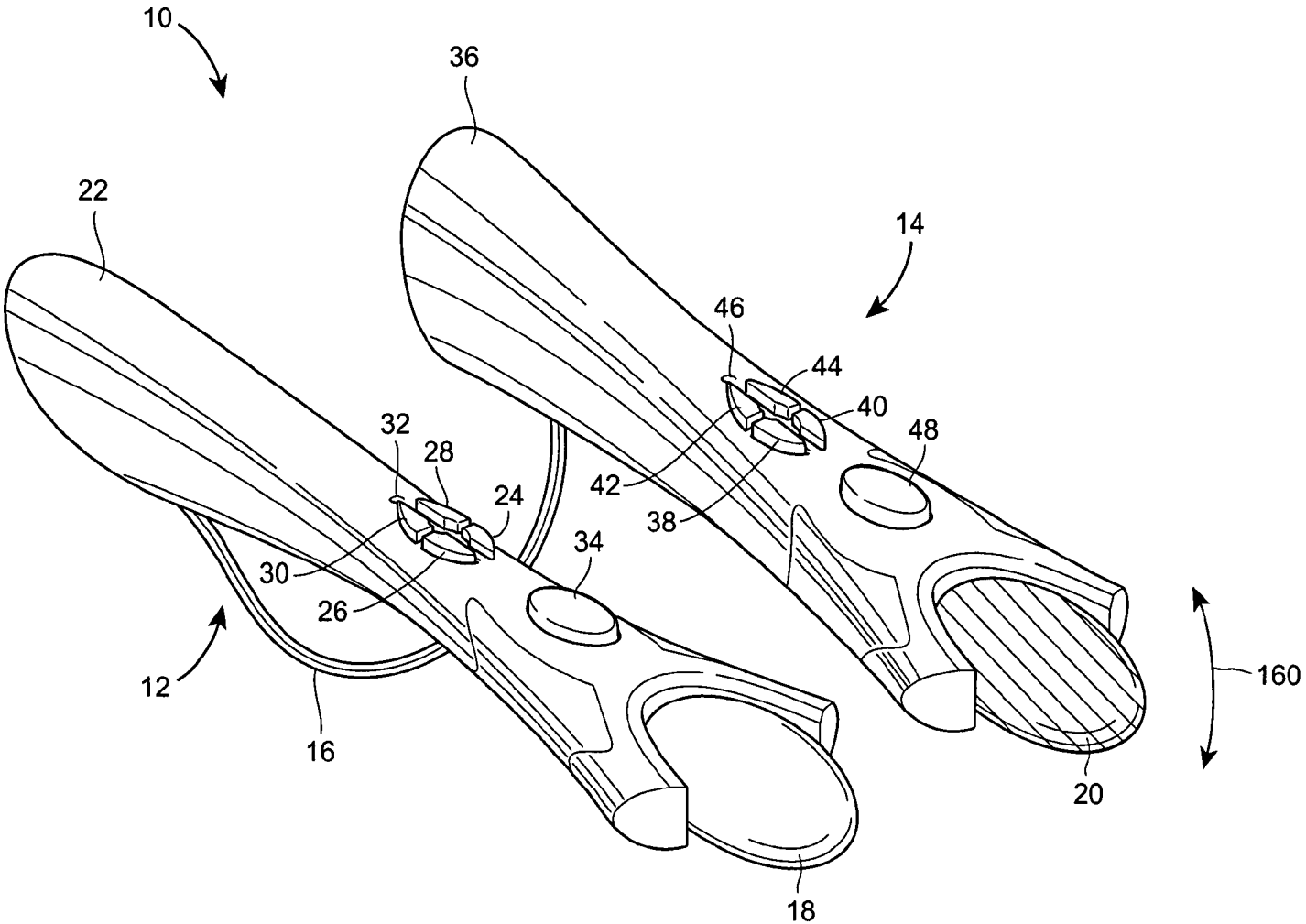
FIG. 5 is a perspective view of the electronic matching game of the FIG. 1 with the bulb of the second elongated stick element illuminated with the color green.

As previously indicated, the colors illuminated by the LEDs 122, 124, 126, 152, 154, 156 may correspond to the sequence generated by the electronic sequence matching game 10 and to the manipulation of the elongated stick members 12, 14 by a player. The illuminated lights may further be accompanied by corresponding sounds output at the speakers 116, 142. In one embodiment of the electronic sequence matching game 10 illustrated in FIGS. 4-8, a player may be required to move the elongated stick members 12, 14 independently or in unison to match a color illuminated by one or more of the LEDs 122, 124, 126, 152, 154, 156. Referring to FIG. 4, a first command signal generated by the first controller 100 may cause the red LED 122 to be illuminated such that the first bulb 18 may appear to turn red. At the same time, the first controller 100 may generate and output a sound generation command signal to the speaker 116 corresponding to the illumination of the red LED 122 that is output by the speaker 116, thereby providing both a visual and an audio indication of the command signals. In this embodiment, when the first bulb 18 is illuminated by the red LED 122, a player grasping the elongate housings 22, 36 may be required to shake the first elongated stick member 12 in a manner similar to shaking a drumstick to bang a drum as indicated by the arrow 158. If the player manipulates the first elongated stick member 12 in the appropriate manner, the movement of the first elongated stick member 12 may close the first motion switch 18, thereby indicating to the first controller 100 that the first elongated stick member 12 has been properly shaken in response to the illumination of the red LED 122. In this event, the first controller 100 may respond by re-illuminating the red LED 122 and causing the speaker 116 to output the corresponding sound.

In the event that the player does not properly manipulate the elongated stick members 12, 14, the first controller 100 and/or the second controller 130 may generate error command signals causing a different illumination of the LEDs 122, 124, 126, 152, 154, 156 and a different sound output at the speakers 116, 142, respectively. For example, after initially illuminating the red LED 122 and outputting the corresponding sound at the speaker 116, the first controller 100 may initiate a timer providing a pre-determined time period within which the player may properly manipulate the first elongated stick member 12 in response to the illumination of the red LED 122. If the first controller 10 does not detect the closing of the motion switch 118 in response to the movement of the first elongated stick member 12 as indicated by the arrow 158 within the pre-determined time period, the first controller 100 may be programmed to terminate the player's turn and cause corresponding illuminations of the LEDs 122, 124, 126 and output of a game ending sounds at the speaker 116. Additionally, the controllers 100, 130 may identify an incorrect manipulation of the elongated stick member 12, 14 by detecting the closing of either the motion switch 146 as a result of the player shaking the second elongated stick member 14, or the closing of one or both of the magnetic switches 120, 148 as a result of the player bringing the elongated stick members 12, 14 in close proximity. Similar to the failure to manipulate the first elongated stick member 12 within the predetermined time period, detection of the closing of the motion switch 146 and/or the magnetic switches 120, 148 may cause the controller 100, 130 to generate an illumination of the LEDs 122, 124, 126, 152, 154, 156 and output of sounds at the speakers 116, 142 corresponding to an end of game condition.

Similar to the illumination of the red LED 122 of the first elongated stick member 12, the electronic sequence matching game 10 may require the second elongated stick member 14 to be shaken by the player in a manner indicated by the arrow 160 (FIG. 5) within the predetermined time period when the second controller 130 causes the green LED 156 to illuminate the second bulb 20 and the second speaker 142 to generate a corresponding sound. If the player correctly manipulates the second elongated stick member 14 to close the motion switch 146 within the predetermined time period, the second controller 130 may cause the green LED 156 to be re-illuminated and the second speaker 142 to generate the corresponding sound. If the motion switch 146 does not close within the predetermined time period, or if the controllers 100, 130 detect the closing of the first motion switch 118 and/or the magnetic switches 120, 148 in response to an improper manipulation of the elongated stick members 12, 14 by the player, the controllers 100, 130 may cause the illumination of the LEDs 122, 124, 126, 152, 154, 156 and output of sounds from the speakers 116, 142 corresponding to the incorrect manipulation by the player.

Figure 6:
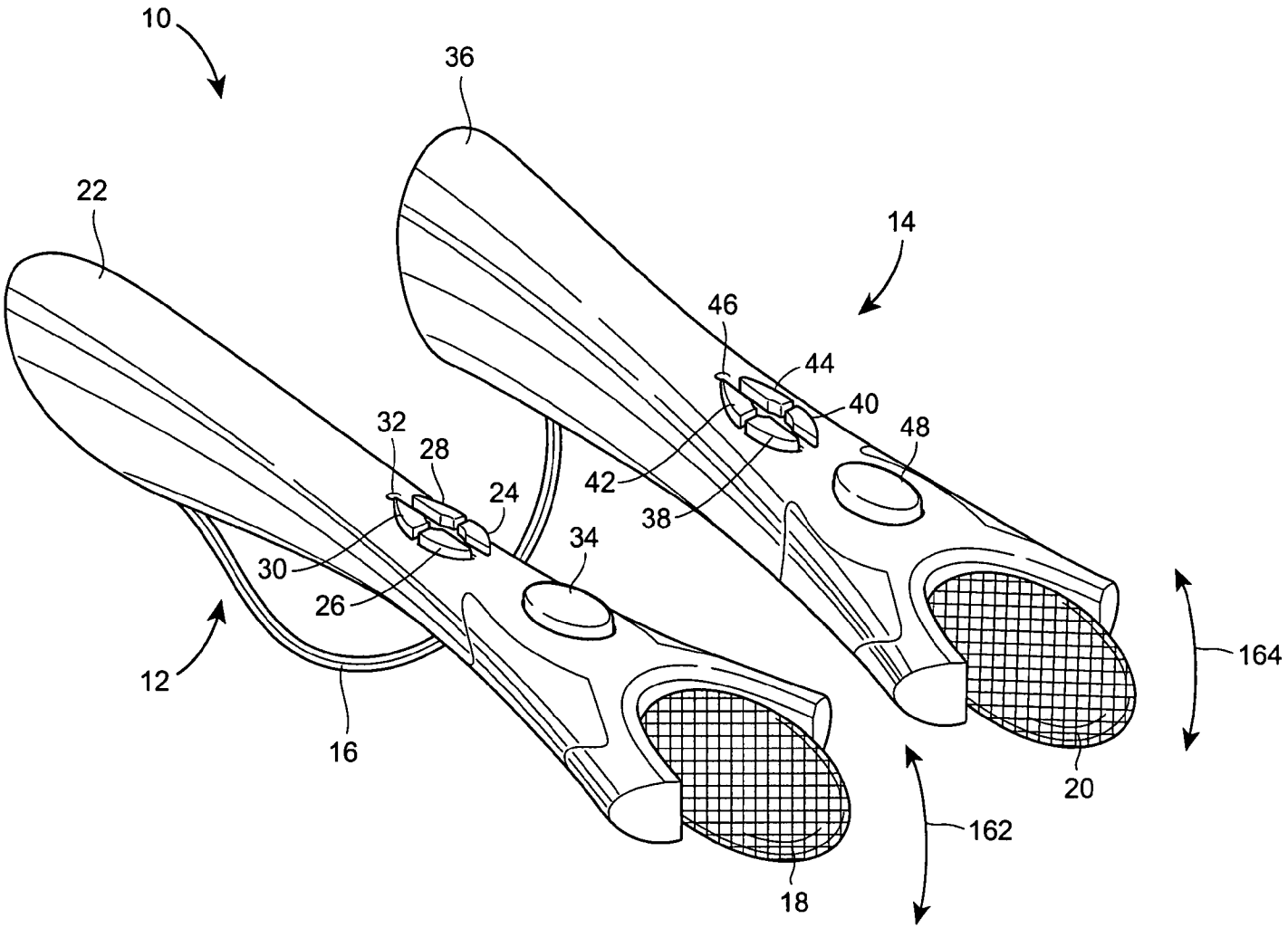
FIG. 6 is a perspective view of the electronic matching game of the FIG. 1 with the bulbs of both elongated stick elements illuminated with the color yellow.

In FIG. 6, the elongated stick members 12, 14 are illustrated with the controllers 100, 130 causing the illumination of both the yellow LEDs 124, 152, respectively. As with the other colors, the controllers 100, 130 may generate command signals causing the speakers 116, 142, respectively, to output sounds corresponding to the yellow color of the bulbs 18, 20. When the bulbs 18, 20 are illuminated by the yellow LEDs 124, 152, respectively, the player may be required to manipulate both the elongated stick members 12, 14 by simultaneously shaking the elongated stick members 12, 14 in a manner simulating the beating of a drum as indicated by the arrows 162, 164 to close both motion switches 118, 146 within the predetermined time period. If the controllers 100, 130 detect the closing of the motion switches 118, 146 within the predetermined time period, the controllers 100, 130 may re-illuminate the yellow LEDs 124, 152 and cause the speakers 116, 142 to generate the corresponding sound to thereby acknowledge the correct manipulation of the elongated stick members 12, 14 by the player. The controllers 100, 130 may detect an improper manipulation by the player if both motion switches 118, 146 did not close within the predetermined time period, or if the magnetic switches 120 and/or 148 close in response to the elongated stick members 12, 14 be moved into close proximity. If the elongated stick members 12, 14 are not properly manipulated, the controller 110, 130 may cause an illumination of the LEDs 122, 124, 126, 152, 154, 156 and output of sounds from the speakers 116, 142 corresponding to an incorrect manipulation of the elongated stick members 12, 14.

Figure 7:
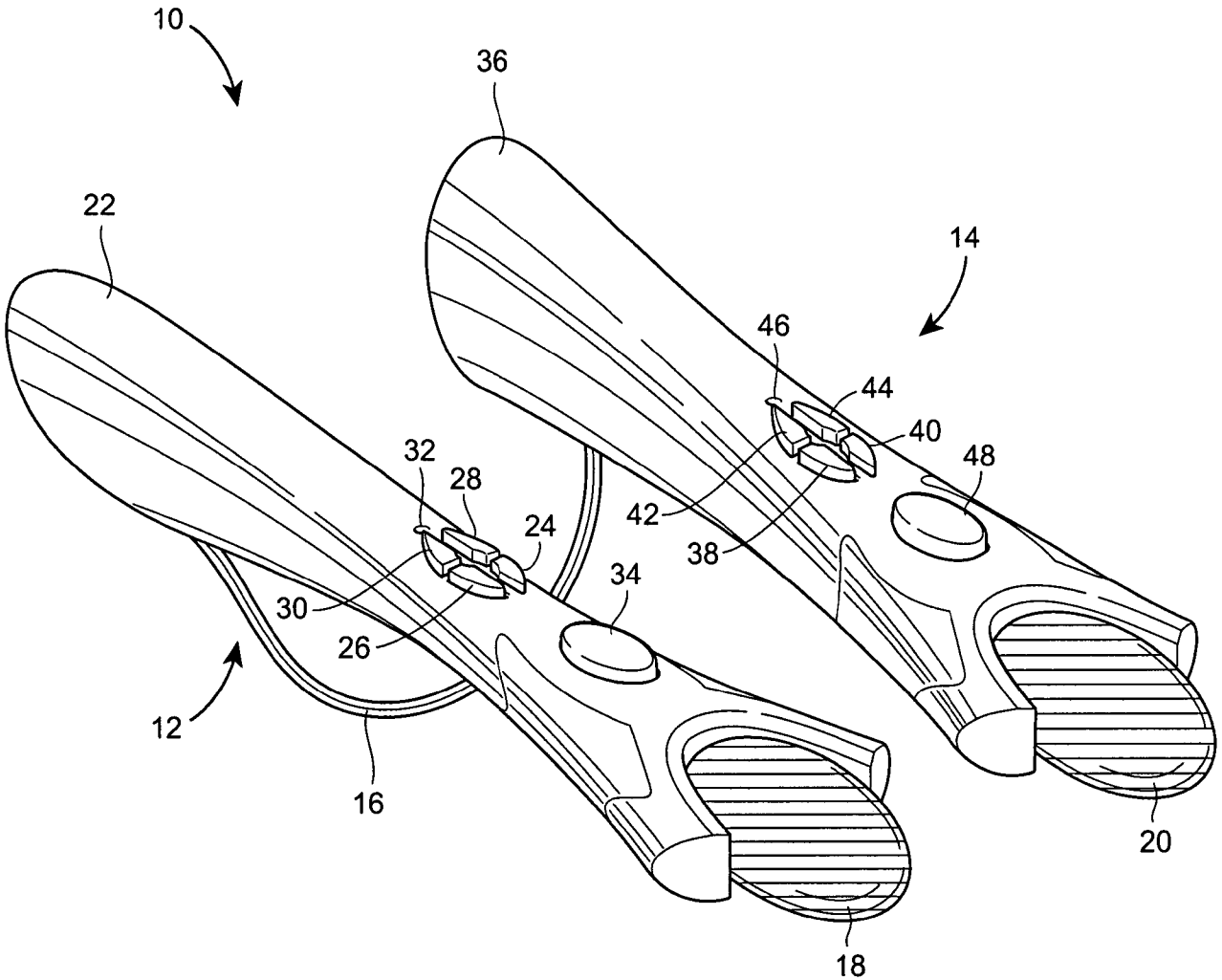
FIG. 7 is a perspective view of the electronic matching game of the FIG. 1 with the bulbs of both elongated stick elements illuminated with the color blue.
Figure 8:
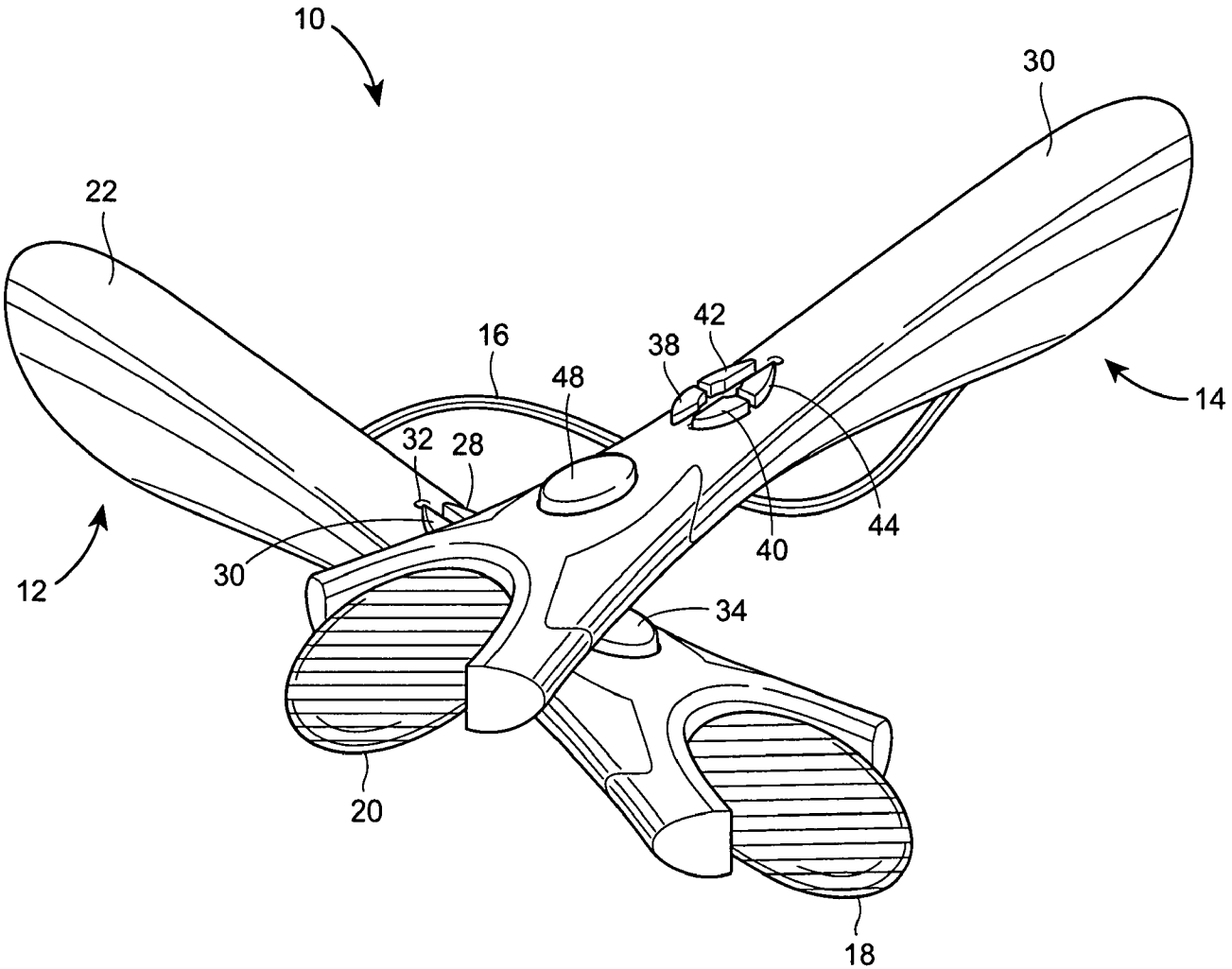
FIG. 8 is a perspective view of the electronic matching game of the FIG. 1 with the bulbs of both elongated stick elements illuminated with the color blue and the elongated stick elements crossed.

Referring to FIGS. 7 and 8, the proper manipulation of the elongated stick members 12, 14 in response to the illumination of the blue LEDs 126, 152 by the controllers 100, 130, respectively, is illustrated. As with the other LEDs, the illumination of the blue LEDs 126, 154 may be accompanied by the generation of corresponding sounds at the speakers 116, 142 in response to sound generation command signals transmitted by the controllers 100, 130, respectively. In response to the illumination of the bulbs 18, 20 by the blue LEDs 126, 154, respectively, the player may be required to cross the elongated stick members 12, 14 such that the ovals 34, 48, 50 and, consequently, the magnetic switches 120, 148 are placed in close proximity such that the magnetic switches 120, 148 cause each other to close. If the controllers 100, 130 detect the closing of the magnetic switches 120, 148, respectively, within the predetermined time period, the controllers 100, 130 may cause the blue LEDs 126, 154, respectively, to be illuminated and the speakers 116, 142, respectively, to output the sounds corresponding to the illumination of the blue LEDs 126, 124. If the magnetic switches 120, 148 do not close within the predetermined time period, or if the controllers 100, 130 detect the closing of one or both of the motion switches 118, 146 in response to shaking of the elongated stick members 12, 14, the controllers 100, 130 may cause an illumination of the LEDs 122, 124, 126, 152, 154, 156 and output of sounds from the speakers 116, 142 corresponding to the improper manipulation of the elongated stick members 12, 14 in response to the illumination of the blue LEDs 126, 154.

Figure 9:
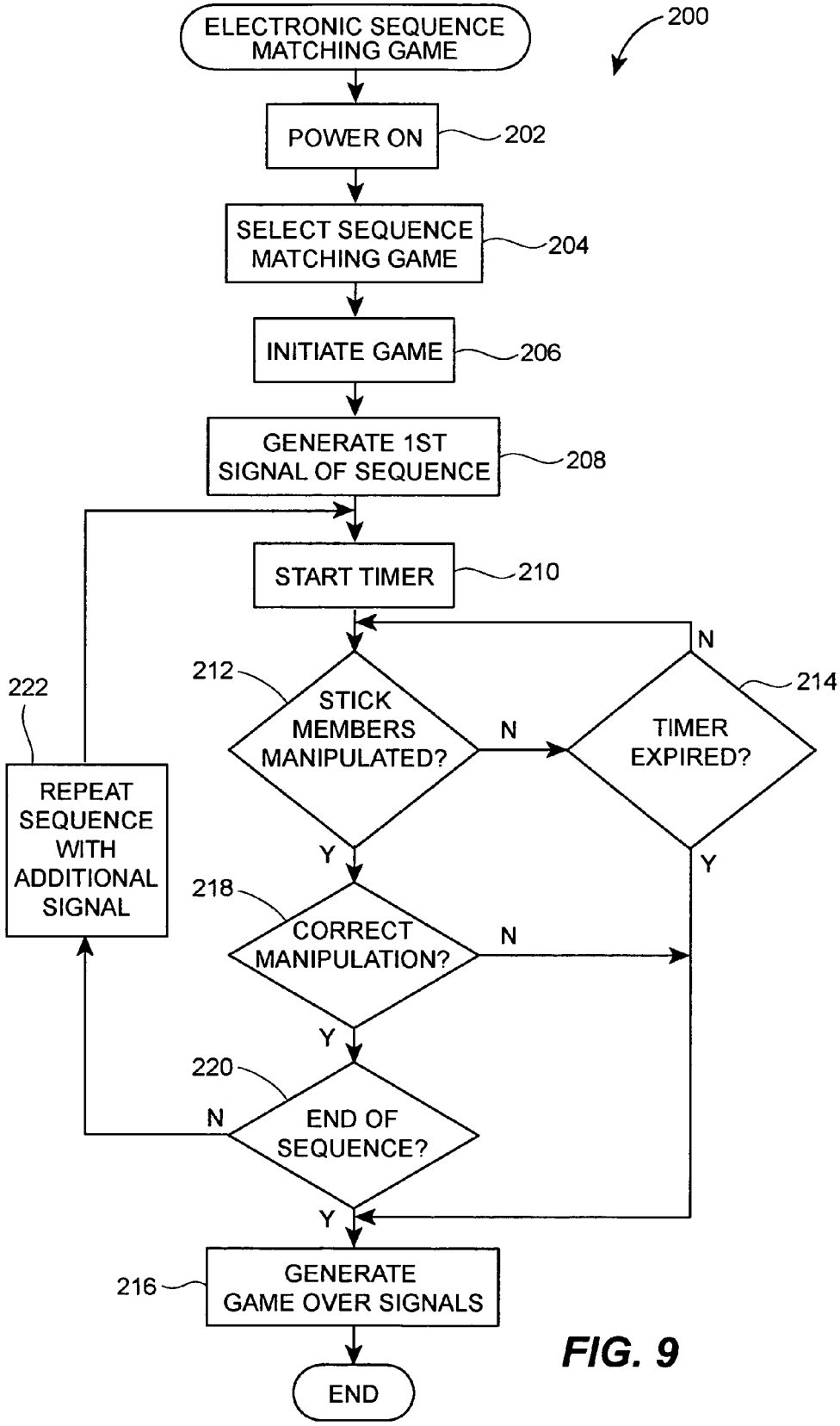
FIG. 9 is a flowchart of an embodiment of a electronic matching game routine that may be performed during game play of the electronic matching game of FIG. 1.

As previously discussed, the electronic sequence matching game 10 may be programmed to offer a plurality of different sequence matching games. FIG. 9 illustrates one embodiment of a sequence matching game routine 200 that may be implemented in the electronic matching game 10. The sequence matching game routine 200 may correspond to a game in which a player must manipulate the elongated stick members 12, 14 to match a sequence generated by the electronic sequence matching game 10. If the player successfully manipulates the elongated stick members 12, 14 to match the generated sequence, the elongated stick members 12, 14 may replay the same sequence and add an additional color at the end of the sequence that the player must also match the next time through the sequence. The routine 200 may begin at a block 202 wherein the player may turn on the electronic sequence matching 10 by depressing the power button 24 to close the power switch 104. Once the electronic sequence matching game 10 is powered on, control may pass to a block 204 wherein the player may select the sequence matching game 200 by depressing the game selection button 26 to close the game selection switch 106 until the controller 100 may cause the speaker 116 to output a sound corresponding to the sequence matching game 200. While not shown in FIG. 6, the player may also depress the other control buttons 28, 30, 38, 40, 42, 44 to set the skill level, background music mix and volume to the settings desired by the players.

Once the player selects the desired sequence matching game 200, control may pass to a block 206 wherein the player may initiate the sequence matching game. In one embodiment, the controllers 100, 130 may be programmed such that the players may cross the elongated stick members 12, 14 in a manner causing the magnetic switches 120, 148 to close. Upon detecting of the closing of the magnetic switches 120, 148 when the electronic sequence matching game 10 is not in the process of executing an occurrence of one of the available sequence matching games, the controllers 100,130 may be programmed to begin a new occurrence of the selected sequence matching game 200. Once the game is initiated, control may pass to a block 208 wherein the controllers 100, 130 may generate the first command signal for a particular sequence used for the occurrence of the sequence matching game 200, and cause the LEDs 122, 124, 126, 152, 154, 156 to illuminate the corresponding color, and cause the speakers 116, 142 to output the corresponding sound for the first command signal. The sequences used during the electronic sequence matching game may be generated in any desired manner. In one embodiment, the sequences may be randomly determined by the controller 100, 130 each time a new sequence is required. In an alternative embodiment, a plurality of available sequences may be stored at the printed circuit boards 102, 132 for use during the electronic sequence matching game. When a new sequence is needed, the controllers 100, 130 may select one of the available sequences randomly, sequentially or by any other appropriate method for use in the occurrence of the game. Other methods for generating and selecting sequences are contemplated as having use with the present invention.

After the first color is illuminated, and the corresponding sound is output, control may pass to a block 210 wherein one of the controllers 100, 130 may start a timer for the predetermined period of time within which the player must manipulate the elongated stick members 12, 14. At a block 212, the controllers 100, 130 may evaluate whether any of the motion switches 118, 146 or the magnetic switches 120, 148 have been closed, thereby signaling manipulation of the elongated stick members 12, 14 by the player. If the controllers 100, 130 have not detected the closing of any of the switches 118, 120, 146, 148, control may pass to a block 214 wherein the controllers 100, 130 evaluate whether the predetermined period of time for manipulating the elongated stick members 12, 14 has expired. If the timer has expired without the player manipulating the elongated stick members 12, 14, control may pass to a block 216 wherein the controllers 100, 130 may cause the illumination of the LEDs 122, 124, 126, 152, 154, 156 and output of sounds from the speakers 116, 142 corresponding to the end of the sequence matching game 200. The end of game indication may include the illumination of one or more of the LEDs 122, 124, 126, 152, 154, 156, and the generation of command signals causing the speakers 114, 142 to output music or other sounds, and/or simulated speech indicating that the game is over, and a player score for the occurrence of the sequence matching game 200.

If the predetermined period of time for manipulating the elongated stick members 12, 14 has not expired, control may be return to block 212 to evaluate whether the elongated stick members 12, 14 have been manipulated. If the elongated stick members 12, 14 are manipulated within the predetermined period of time, control may pass to a block 218 wherein the controllers 100, 130 may determine whether the elongated stick members 12, 14 were correctly manipulated by the player. As discussed above with respect to FIGS. 4-8, the elongated stick members 12, 14 are correctly manipulated if the switches 118, 120, 146, 148 corresponding to the illuminated colors have been closed in response to the manipulation of the elongated stick members 12, 14 by the player. If the player does not correctly manipulate the elongated stick members 12, 14 in the manner corresponding to the illuminated color and output sound, control may pass to the block 216 to illuminate the LEDs 122, 124, 126, 152, 154, 156 and output sounds from the speakers 116, 142 in the manner previously described.

If the player has correctly manipulated the elongated stick members 12, 14, control may pass to a block 220 wherein the controllers 100, 130 may determine whether the electronic matching game 200 has reached the end of the sequence for the occurrence of the game. If the electronic matching game 200 has not reached the end of the sequence, control may pass to a block 222 wherein the controllers 100, 130 may repeat the sequence matched by the player and add an additional command signal to illuminate the corresponding LED 122, 124, 126, 152, 154, 156, and to cause the output of a corresponding sound at the speakers 116, 142. After regenerating the sequence with the additional command signal, control may pass back to the block 210 wherein the controllers 100, 130 may start the timer for the predetermined period of time, and to block 212 wherein the controllers 100, 130 may evaluate whether the player has manipulated the elongated stick members 12, 14 in an effort to match the sequence.

Once the controllers 100, 130 detect that the player has manipulated the elongated stick members 12, 14, control passes to the block 218 to evaluate whether the player has correctly manipulated the elongated stick members 12, 14. It should be noted that the controllers 100, 130 must now evaluate whether the player correctly manipulates the elongated stick members 12, 14 to match the first command signal in the sequence followed by the second command signal in the sequence. For example, the first two command signals in the sequence may cause the illumination of the red LED 122 and output of the corresponding sound from speaker 116, followed by the illumination of the green LED 156 and output of the corresponding sound at the speaker 142. In order to correctly match the sequence, the player must first shake the first elongated stick member 12 in the manner illustrated in FIG. 4, and then shake the second elongated stick member 14 in the manner illustrated in FIG. 5. In order to determine that the player has correctly manipulated the elongated stick members 12, 14 to match the sequence, the first controller 100 may be required to detect the closing of the motion switch 118, followed by the detection of the closing of the motion switch 146 by the second controller 130. If the controllers 100, 130 detect the closing of the motion switches 118, 146 in the proper sequence, the controllers 100, 130 may be programmed to pass control to the block 220 to evaluate whether the player has reached the end of the sequence. The controllers 100, 130 will continue to perform similar evaluations of the closing of the switches 118, 120, 146, 148 as the length of the sequences increased and the player manipulates the elongated stick members 12, 14. While not shown, the controllers 100, 130 may be programmed such that the player may be provided with a limited amount of time between manipulations of the elongated stick members 12, 14 as the player attempts to match a subsequent command signal within the sequence after correctly matching the preceding command signal of the sequence. Once a player successfully reaches the end of the sequence at the block 220, control may pass to the block 216 wherein the controllers 100, 130 may cause the illumination of the LEDs 122, 124, 126, 152, 154, 156 and output of sounds at the speakers 116, 142 indicative of the players successful completion of the occurrence of the sequence matching game 200.

Figure 10:
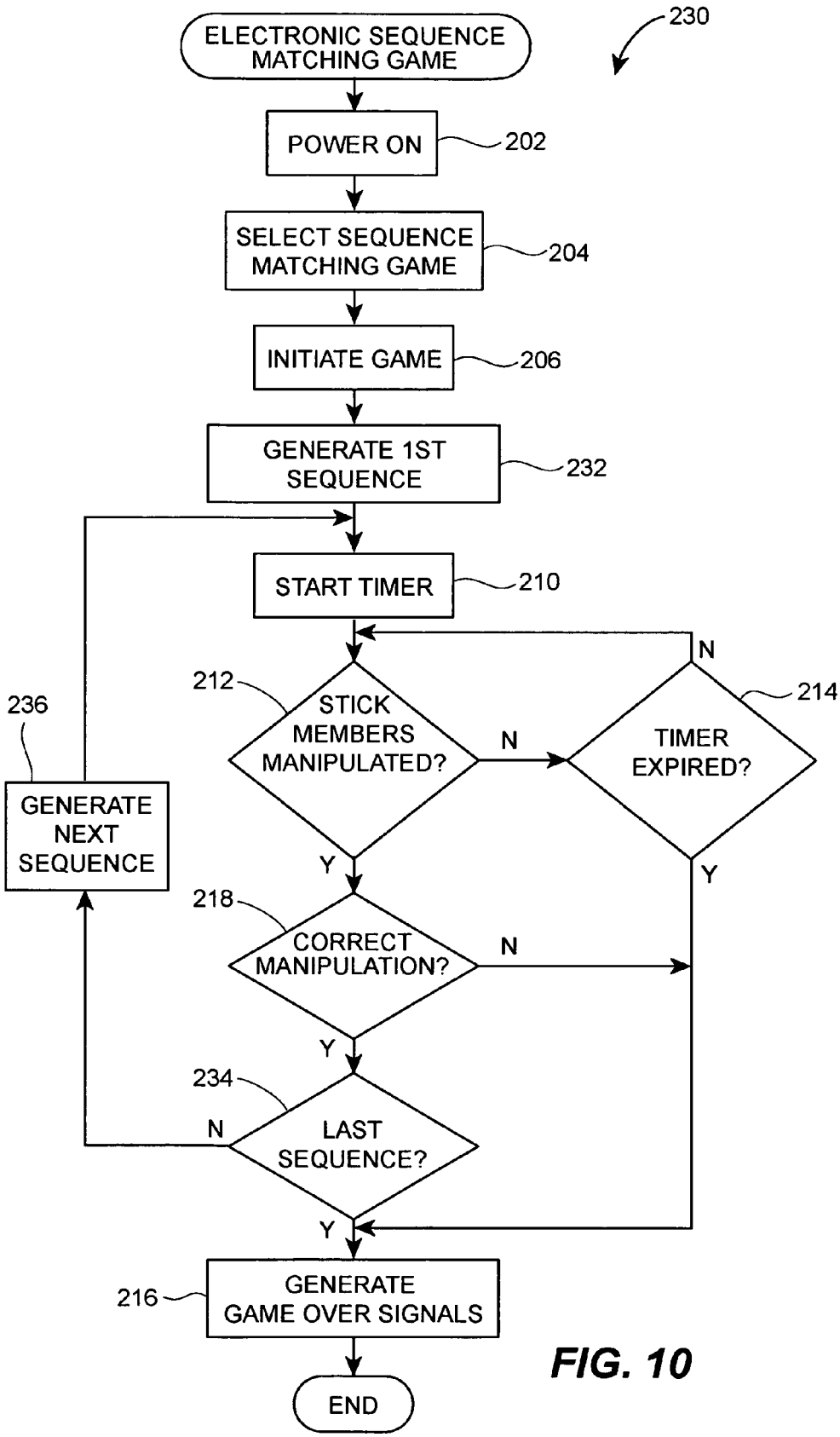
FIG. 10 is a flowchart of an embodiment of another electronic matching game routine that may be performed during game play of the electronic matching game of FIG. 1.

FIG. 10 illustrates another sequence matching game routine 230 that may be implemented with the elongated stick members 12, 14. As with the previously described routine 200, the sequence matching game routine 230 may begin with a player powering on the elongated stick members 12, 14 at block 202, selecting the desired sequence matching game at block 204, and initiating the selected game at block 206. Once the sequence matching game 230 is initiated, control may pass to a block 232 where the controllers 100, 130 generate a first sequence to be matched by the player. The first sequence may include a plurality of command signals generated by the controllers 100, 130, with the length of the sequence being determined, at least in part, on the skill level selected by the player. For example, the controllers 100, 13Q may generate a sequence wherein the controller 100 causes the red LED 122 to be illuminated, followed by the controller 130 causing the green LED 156 to be illuminated, the controllers 100, 130 causing the yellow LEDs 124, 152 to be illuminated, and finally the controllers 100, 130 causing the blue LEDs 126, 154 to be illuminated. As each of the LEDs 122, 124, 126, 152, 154, 156 are illuminated, the controllers 100, 130 may also cause the speakers 116, 142 to output sounds corresponding to the illuminated colors.

Once a first sequence is generated by the controllers 100, 130 and output at the elongated stick members 12, 14, the controllers 100, 130 may start the timer at block 210, and evaluate whether the stick members have been manipulated or the timer has expired at blocks 212, 214, respectively, in the manner previously described with respect to FIG. 9. Once the controllers 100, 130 detect the manipulation of the elongated stick members 12, 14 by the player, the controllers 100, 130 may evaluate whether the elongated stick members 12, 14 have been correctly manipulated by the player at the block 218. In the above example, the correct manipulation of the elongated stick members 12, 14 would include shaking the first elongated stick member 12 in the manner illustrated in FIG. 4 to close the first motion switch 118, shaking the second elongated stick member 14 in the manner illustrated in FIG. 5 to cause the second motion switch 146 to close, shaking both elongated stick members 12, 14 in the manner illustrated in FIG. 6 to cause both motion switches 118, 146 to close, and finally crossing the elongated stick members 12, 14 in the manner illustrated in FIG. 8 to cause the magnetic switches 120, 148 to close. If the player does not correctly manipulate the elongated stick members 12, 14 within the predetermined period of time, control may pass to the block 216 wherein the controllers 100, 130 may generate error or game over command signals in the manner previously described. If the player correctly manipulates the elongated stick members 12, 14, control may pass to a block 234 wherein the controllers 100, 130 evaluate whether the sequence matched by the player is the last sequence for the occurrence of the sequence matching game 230. If the matched sequence is not the last sequence for the occurrence of the sequence matching game 230, control may pass to a block 236 wherein the controllers 100, 130 may generate the next sequence to be matched by the player during the occurrence of the sequence matching game 230. The sequence matching game 230 may proceed in a similar manner until the player does not match a sequence, or until the player successfully matches the last sequence for the occurrence of the sequence matching game 230. As previously discussed, other variations, of sequence matching games may be implemented in the electronic sequence matching game 10.

Thus, while the present invention has been described with reference to specific examples, which are intended to be illustrative only and not to be limiting of the invention, it will be apparent to those of ordinary skill in the art that changes, additions or deletions may be made to the disclosed embodiments without departing from the spirit and scope of the invention.

What is claimed is:

1. An electronic game for use by at least one player, comprising:

a first game element having a first illumination source configured to illuminate a plurality of different colors, and a first motion switch configured to detect movement of the first game element by the player; and a second game element having a second illumination source configured to illuminate a plurality of different colors, and a second motion switch configured to detect movement of the second game element by the player, wherein the first and second game elements are physically separate game elements that may be moved by a player independently of each other, and wherein the second game element is operatively coupled to the first game element, wherein each of the plurality of colors illuminated by the first and the second illumination sources corresponds to a particular movement of at least one of the first and the second game elements by the player, and where the first and second motion switches are configured to compare the movement of the first and second game elements by the player to the particular movement corresponding to an illuminated one of the plurality of different colors.

2. An electronic game as defined in claim 1, wherein the first and second game elements are configured to cause the first and second illumination sources to illuminate at least one of the plurality of different colors in a particular sequence, and wherein the first and second motion switches are configured to compare the sequence of the detected movement of the first and second game elements to the particular sequence of illuminating the at least one of the different colors.

3. An electronic game as defined in claim 2, wherein the first and second game elements are configured to cause the first and second illumination sources to illuminate the at least one of the plurality of different colors in the particular sequence and to illuminate an additional one of the plurality of different colors after the particular sequence in response to determining that the sequence of movement of the first and second game elements detected by the first and second motion switches corresponds to the particular sequence of illuminating the at least one of the different colors.

4. An electronic game as defined in claim 2, wherein the first and second game elements are configured to cause the first and second illumination sources to illuminate the at least one of the plurality of different colors in a second particular sequence in response to determining that the sequence of movement of the first and second game elements detected by the first and second motion switches corresponds to the particular sequence of illuminating the at least one of the different colors.

5. An electronic game as defined in claim 2, wherein the first and second game elements are configured to cause the first and second illumination sources to illuminate the at least one of the plurality of different colors in a game ending sequence in response to determining that the sequence of movement of the first and second game elements detected by the first and second motion switches do not correspond to the particular sequence of illuminating the at least one of the different colors.

6. An electronic game as defined in claim 1, wherein the first game element has a first speaker configured to generate a sound corresponding to each of the plurality of different colors illuminated by the first illumination source, and the second game element has a second speaker configured to generate a sound corresponding to each of the plurality of different colors illuminated by the second illumination source.

7. An electronic game for use by at least one player, comprising:

a first game element having a first illumination source configured to illuminate a plurality of different colors, and a first manipulation detection mechanism configured to detect the manipulation of the first game element by the player; and a second game element having a second illumination source configured to illuminate a plurality of different colors, and a second manipulation detection mechanism configured to detect the manipulation of the second game element by the player, wherein the second game element is operatively coupled to the first game element, wherein each of the plurality of colors illuminated by the first and the second illumination sources corresponds to a particular manipulation of at least one of the first and the second game elements by the player, where the first and second manipulation detection mechanisms are configured to compare the manipulation of the first and second game elements by the player to the particular manipulation corresponding to an illuminated one of the plurality of different colors, wherein the first illumination source is configured to illuminate a first color, a second color and a third color, and the second illumination source is configured to illuminate the second color, the third color and a fourth color, wherein the first and second manipulation detection mechanisms are configured to detect motion of the first and second game elements, respectively, wherein at least one of the first and second manipulation detection mechanisms is configured to detect the proximity of the first and the second game elements to each other, wherein the detection of motion of only the first game element by the first and the second manipulation detection mechanisms corresponds to the illumination of the first color by the first illumination source, wherein the detection of motion of both the first and second game elements by the first and the second manipulation detection mechanisms corresponds to the illumination of the second color by the first and second illumination sources, wherein the detection of only the first and second game elements being disposed in close proximity by the at least one of the first and the second manipulation detection mechanisms corresponds to the illumination of the third color by the first and second illumination sources, and wherein the detection of motion of only the second game element by the first and the second manipulation detection mechanisms corresponds to the illumination of the fourth color by the second illumination source.

8. An electronic game for use by at least one player, comprising:

a first elongated game element, comprising:

a first illumination source configured to illuminate a first color, a second color and a third color, a first motion switch, a first magnetic switch, and a first controller operatively coupled to the first illumination source, the first motion switch and the first magnetic switch;

a second elongated game element, comprising:

a second illumination source configured to illuminate the second color, the third color and a fourth color, a second motion switch, a second magnetic switch, and a second controller operatively coupled to the second illumination source, the second motion switch, the second magnetic switch and the first controller, the first controller being programmed to cause the first illumination source to illuminate the first color in response to detecting motion of the first elongated game element at the first motion switch, and not detecting motion of the second elongated game element at the second motion switch, the first controller being programmed to cause the first illumination source to illuminate the second color, and the second controller being programmed to cause the second illumination source to illuminate the second color, in response to detecting motion of the first elongated game element at the first motion switch, and motion of the second elongated game element at the second motion switch, the first controller being programmed to cause the first illumination source to illuminate the third color, and the second controller being programmed to cause the second illumination source to illuminate the third color, in response to detecting that the first magnetic switch is disposed proximate the second magnetic switch, and the second controller being programmed to cause the second illumination source to illuminate the fourth color in response to detecting motion of the second elongated game element at the second motion switch, and not detecting motion of the first elongated game element at the first motion switch.

9. An electronic game as defined in claim 8, wherein:

the first and the second controllers are programmed to cause the first and the second illumination sources to illuminate at least one of the first, second, third and fourth colors in a particular sequence;

the first and the second controllers are programmed to detect the actuation of the motion switches and the magnetic switches in the response to manipulation of the first and the second elongated game elements; and the first and the second controllers are programmed to compare the sequence of the actuation of the motion switches and the magnetic switches to the particular sequence of illumination of the first, second, third and fourth colors.

10. An electronic game as defined in claim 9, wherein the first and the second controllers are programmed to cause the first and the second illumination sources to illuminate the first, second, third and fourth colors in the particular sequence and to illuminate an additional one of the first, second third and fourth colors after the particular sequence in response to determining that the sequence of actuation of the motion switches and the magnetic switches corresponds to the particular sequence of illumination of the first, second, third and fourth colors.

11. An electronic game as defined in claim 9, wherein the first and the second controllers are programmed to cause the first and the second illumination sources to illuminate at least one of the first, second, third and fourth colors in a second particular sequence in response to determining that the sequence of actuation of the motion switches and the magnetic switches corresponds to the particular sequence of illumination of the first, second, third and fourth colors.

12. An electronic game as defined in claim 9, wherein the first and the second controllers are programmed to cause the first and the second illumination sources to illuminate at least one of the first, second, third and fourth colors in a game ending sequence in response to determining that the sequence of actuation of the motion switches and the magnetic switches does not correspond to the particular sequence of illumination of the first, second, third and fourth colors.

13. An electronic game as defined in claim 9, wherein one of the first and the second elongated game elements comprises at least one skill level adjustment switch operatively coupled the corresponding first or second controllers, the first and second controllers being programmed to cause the first and second illumination sources to illuminate the particular sequence with a different speed in response to detecting the actuation of the at least one skill level adjustment switch.

14. An electronic game as defined in claim 9, wherein one of the first and the second elongated game elements comprises at least one skill level adjustment switch operatively coupled the corresponding first or second controllers, the first and second controllers being programmed to cause the first and second illumination sources to illuminate a particular sequence having a different number of first, second third and fourth colors illuminated in response to detecting the actuation of the at least one skill level adjustment switch.

15. An electronic game as defined in claim 8, wherein the first elongated game element comprises a first speaker operatively coupled to the first controller and the first controller is programmed to cause the first speaker to generate one of a first, a second and a third sound when the first controller causes the first illumination source to illuminate a corresponding one of the first, the second and the third colors, respectively, and wherein the second elongated game element comprises a second speaker operatively coupled to the second controller and the second controller is programmed to cause the second speaker to generate one of the second, the third and a fourth sound when the second controller causes the second illumination source to illuminate a corresponding one of the second, the third and the fourth colors, respectively.

16. An electronic game as defined in claim 15, wherein the first and the second controllers are programmed to cause the first and the second speakers to generate one of at least one available background music selection.

17. An electronic game as defined in claim 16, wherein one of the first and the second elongated game elements comprises at least one background music selection switch operatively coupled the corresponding first or second controllers, the first and second controllers being programmed to cause the speakers to generate a different one of the available background music selections in response to detecting the actuation of the at least one background music selection switch.

18. An electronic game as defined in claim 15, wherein one of the first and the second elongated game elements comprises at least one volume adjustment switch operatively coupled the corresponding first or second controllers, the first and second controllers being programmed to cause the speakers to generate sounds with a different volume in response to detecting the actuation of the at least one volume adjustment switch.

19. An electronic game as defined in claim 8, comprising a cord operatively coupling the first controller to the second controller.

20. An electronic game as defined in claim 8, wherein the first and second illumination sources comprise tri-colored LEDs.

21. A method for providing an electronic game for use by at least one player, comprising:

providing first and second physically separate operatively couple game elements, wherein the physically separate game elements may be moved independently of each other by a player, wherein the first and second game elements are responsive to physical movements of the game elements alone and relative to each other by the player, and are each configured to illuminate a plurality of different color lights;

configuring the first and second game elements to illuminate a sequence of the different color lights;

configuring the first and second game elements to detect the movements of the first and second game elements by the player after the first and second game elements illuminate the sequence of different color lights, wherein each of the different color lights has a corresponding movement of at least one of the first and second game elements; and configuring the first and the second elements to compare the sequence of the detected movements of the first and second game elements to the sequence of different color lights.

22. A method for providing an electronic game as defined in claim 21, comprising configuring the first and second game elements to illuminate the sequence of different color lights and to illuminate an additional one of the different color lights after the sequence in response to determining that the sequence of detected movements of the first and second game elements corresponds to the sequence of the different color lights.

23. A method for providing an electronic game as defined in claim 21, comprising configuring the first and second game elements to illuminate a second sequence of different color lights in response to determining that the sequence of detected movements of the first and second game elements corresponds to the sequence of the different color lights.

24. A method for providing an electronic game as defined in claim 21, comprising configuring the first and second game elements to illuminate a game ending sequence of the different color lights in response to determining that the sequence of detected movements of the first and second game elements does not correspond to the sequence of the different color lights.

25. A method for providing an electronic game as defined in claim 21, comprising:

configuring the first game element to generate a sound corresponding to each of the different color lights illuminated by the first game element; and configuring the second game element to generate a sound corresponding to each of the different color lights illuminated by the second game element.

26. A method for providing an electronic game for use by at least one player, comprising:

providing first and second operatively couple game elements, wherein the first and second game elements are responsive to manipulations by the player, and are each configured to illuminate a plurality of different color lights;

configuring the first and second game elements to illuminate a sequence of the different color lights;

configuring the first and second game elements to detect the manipulation of the first and second game elements by the player after the first and second game elements illuminate the sequence of different color lights, wherein each of the different color lights has a corresponding manipulation of at least one of the first and second game elements;

configuring the first and the second elements to compare the sequence of the detected manipulations of the first and second game elements to the sequence of different color lights;

configuring the first game element to illuminate a first color, a second color and a third color, and to detect motion of the first game element;

configuring the second game element to illuminate the second color, the third color and a fourth color, and to detect motion of the second game element; and configuring at least one of the first and second game elements to detect the proximity of the first and the second game elements to each other, wherein the detection of motion of only the first game element corresponds to the illumination of the first color by the first game element, wherein the detection of motion of both the first and second game elements corresponds to the illumination of the second color by the first and second game elements, wherein the detection of only the first and second game elements being disposed in close proximity corresponds to the illumination of the third color by the first and second game elements, and wherein the detection of motion of only the second game element corresponds to the illumination of the fourth color by the second game element.

27. A game apparatus, comprising:

a pair of physically separate game elements operatively coupled to each other, wherein the physically separate game elements may be moved independently of each other by a player, each game element comprising:

a plurality of input devices each requiring manipulation of at least the corresponding game element for actuation, wherein at least two of the input devices require different manipulations for actuation, a visual output device, and a controller operatively coupled to each of the input devices and to the visual output device;

wherein the controllers output a first sequence of first command signals to the visual output devices, each of the first command signals of the first sequence corresponding to one of the plurality of input devices;

wherein the controllers further output a second sequence of first command signals to the visual output devices when the input devices corresponding to the first command signals are actuated in the first sequence within a predetermined period of time, each of the first command signals of the second sequence corresponding to one of the plurality of input devices; and wherein the controllers further output first error command signals to the visual output devices when the input devices are not actuated in the first sequence and when the input devices are not actuated within the predetermined period of time.

28. A game apparatus as defined in claim 27, wherein the second sequence of first command signals comprises the first sequence of first command signals followed by an additional first command signal.

29. A game apparatus as defined in claim 27, wherein the second sequence of first command signals does not duplicate the first sequence of first command signals.

30. A game apparatus as defined in claim 27, wherein each of the visual output devices comprises a multi-color illumination source, and wherein a color illuminated by the illumination source corresponds to each manipulation required for actuation of at least one of the plurality of input devices.

31. A game apparatus as defined in claim 27, wherein the input devices for each game element include a motion switch and a magnetic switch.

32. A game apparatus as defined in claim 27, wherein each of the game elements comprises an audible output device operatively coupled to the controller, wherein the controllers output second command signals corresponding to the first command signals to the audible output devices when the controllers output the first and second sequences of first command signals, and wherein the controllers further output second error command signals corresponding to the first error command signals to the audible output devices when the controllers output the first error command signals.

33. A method of playing an electronic sequence matching game, comprising:

outputting a first sequence of first command signals to visual output devices of a pair of physically separate operatively coupled game elements capable of being moved independently of each other by a player, each of the first command signals of the first sequence corresponding to one of a plurality of input devices of the game elements, wherein the plurality of input devices each require manipulation of at least the corresponding game element for actuation, and wherein at least two of the input devices require different types of manipulations for actuation;

outputting a second sequence of first command signals to the visual output devices when the input devices corresponding to the first command signals are actuated in the first sequence within a predetermined period of time, each of the first command signals of the second sequence corresponding to one of the plurality of input devices; and outputting first error command signals to the visual output devices when the input devices are not actuated in the first sequence and when the input devices are not actuated within the predetermined period of time.

34. A method of playing an electronic sequence matching game as defined in claim 33, wherein the second sequence of first command signals comprises the first sequence of first command signals followed by an additional first command signal.

35. A method of playing an electronic sequence matching game as defined in claim 33, wherein the second sequence of first command signals does not duplicate the first sequence of first command signals.

36. A method of playing an electronic sequence matching game as defined in claim 33, wherein each of the visual output devices comprises a multi-color illumination source, and wherein a color illuminated by the illumination source corresponds to each manipulation required for actuation of at least one of the plurality of input devices.

37. A method of playing an electronic sequence matching game as defined in claim 33, wherein the input devices for each game element include a motion switch and a magnetic switch.

38. A method of playing an electronic sequence matching game as defined in claim 33, comprising:

outputting second command signals corresponding to the first command signals to audible output devices of the game elements when the first and second sequences of first command signals are output to the visual output devices; and outputting second error command signals corresponding to the first error command signals to the audible output devices when the first error command signals are output to the visual output devices.

* * * * *

UNITED STATES PATENT AND TRADEMARK OFFICE

CERTIFICATE OF CORRECTION

PATENT NO. : 7,351,148 B1
APPLICATION NO. : 10/941590
DATED : April 1, 2008
INVENTOR(S) : Omri Rothschild et al.

It is certified that error appears in the above-identified patent and that said Letters Patent is hereby corrected as shown below:

On the Title Page:

Item (75), Inventor, "Tel Aviv-Jaffa" should be -- Tel Aviv --.

Item (73), Assignee, "R.R" should be -- R.R. --.

Item (73), Assignee, "Tel Aviv-Yafo" should be -- Tel Aviv --.

Item (57), Abstract, line 3, "the may" should be -- that may --.

At Column 18, line 51, "second" should be -- second, --.

At Column 19, line 21, "second" should be -- second, --.

Signed and Sealed this

Twenty-fourth Day of February, 2009

JOHN DOLL
*Acting Director of the United States Patent and Trademark Office*